US007301283B1

(12) United States Patent
Callahan et al.

(10) Patent No.: US 7,301,283 B1
(45) Date of Patent: Nov. 27, 2007

(54) STARTING AID FOR LOW WATTAGE METAL HALIDE LAMPS

(75) Inventors: Susan L. Callahan, Peterborough, NH (US); David M. Hrubowchak, Lithchfield, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/716,337

(22) Filed: Mar. 10, 2007

(51) Int. Cl.
*H01J 17/16* (2006.01)

(52) U.S. Cl. ..... 313/634; 313/595; 313/335; 313/318.07; 313/25; 315/60; 315/344

(58) Field of Classification Search ..... 315/60, 315/267, 344; 313/17, 25, 39, 335, 578, 313/579, 318.07, 595, 631, 601, 634
See application file for complete search history.

(56) References Cited

U.S. PATENT DOCUMENTS 3,900,761 A * 8/1975 Freese et al. ..... 315/60
4,818,915 A 4/1989 Zaslavsky et al. ..... 315/60
5,136,204 A * 8/1992 Muzeroll et al. ..... 313/25
5,323,091 A 6/1994 Morris ..... 315/344
5,959,404 A * 9/1999 Nortrup et al. ..... 313/634
6,249,077 B1 * 6/2001 Brown et al. ..... 313/25

* cited by examiner

*Primary Examiner*—Haissa Philogene
(74) *Attorney, Agent, or Firm*—William H. McNeill

(57) ABSTRACT

An arc discharge lamp (60) contains an arc tube (62) containing an arc generating and sustaining medium. The arc tube (62) has at least one press seal (64). Means (66) for coupling electrical energy to the interior of the arc tube includes an electrical current-carrying frame member (68) and in-leads (68*a*) and (68*b*) sealed into the lamp stem (90) and connected to a base (not shown). A starting source (70) comprises a sealed cavity (72) formed in the press seal (64). A second fill material is contained within the sealed cavity (72). The starting source (70) emits ultraviolet radiation when the lamp (60) is energized, which assists in initiation of the arc discharge within the interior of the arc tube (62). An electrical energy coupler (74) is provided for coupling electrical energy to the sealed cavity (72). The electrical energy coupler (74) comprises an electrically conducting element (76) having a proximal end (78) affixed to the electrical current-carrying frame (68) and a distal end (80) overlying the starting source (70), thus providing a capacitve coupling.

3 Claims, 3 Drawing Sheets

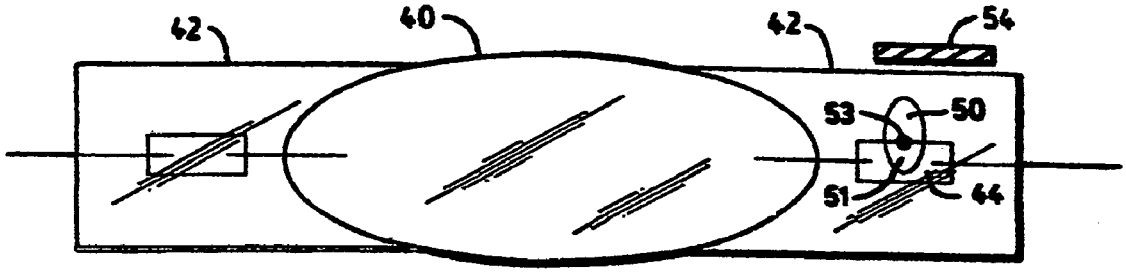
FIG. 2
PRIOR ART
FIG. 3
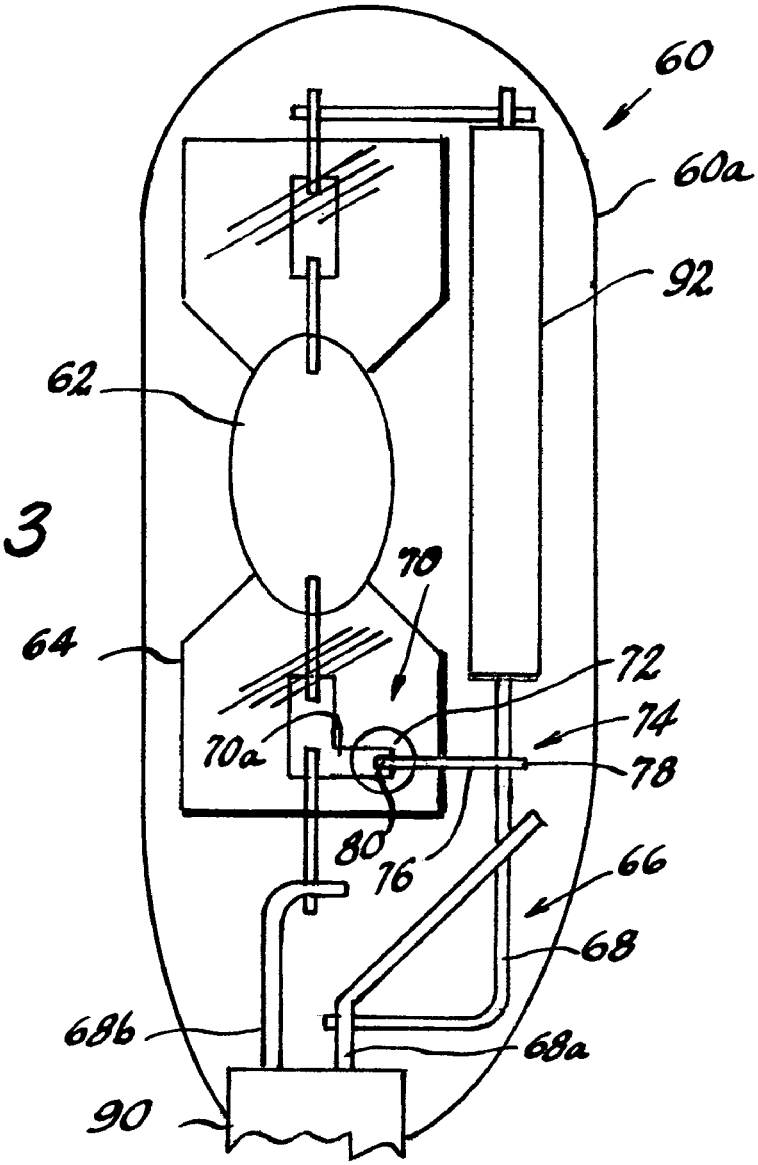

STARTING AID FOR LOW WATTAGE METAL HALIDE LAMPS

TECHNICAL FIELD

This invention relates to a starting source for an arc discharge lamp. More particularly it relates to a starting source that provides ultraviolet radiation to aid in the initial breakdown of the arc.

BACKGROUND ART

High pressure metal halide arc discharge lamps typically comprise an arc tube, which encloses an ionizable fill material and two electrodes at opposing ends of the tube. To reduce the time it takes to start the lamp, a starter electrode may be disposed inside the arc tube near one of the main electrodes, as shown in Freese et. al., U.S. Pat. No. 3,900,761. A discharge can be initiated between the starter electrode and one of the main electrodes at a voltage that is much lower than the voltage required to ignite an arc between the two main electrodes. The ultraviolet radiation from this discharge produces photoelectrons, which enhance gas breakdown and discharge formation in the arc tube between the two main electrodes.

Zaslavsky et al., U.S. Pat. No. 4,818,915, issued Apr. 4, 1989, discloses a UV enhancer that is separate from the arc tube. The '915 patent describes a UV enhancer that typically has a borosilicate glass envelope enclosing an ionizable fill material and a single electrode. The single electrode has a getter, which can remove certain gases when the envelope heats and outgases. When energized, the UV enhancer produces ultraviolet radiation, which illuminates the path between the main electrodes within the arc tube, thus decreasing the time for generating a high intensity arc discharge.

The starter electrode approach and the separate UV enhancer each require additional parts and manufacturing steps. The extra parts and steps add to the lamp manufacturing cost.

Another form of starting aid employs a radioactive material, usually Kr85; however, this also increases the expense of the lamp and, of course, requires special handling in the storage of the material.

U.S. Pat. No. 5,323,091 to Morris discloses a UV starting aid that is incorporated into the press seal of the arc tube.

Further, to minimize sodium loss during lamp operation, the arc tube is mounted upon a floating frame, that is, a frame that carries no electrical current. The arc tube, and a shroud if the discharge lamp is a protected lamp, is supported from the frame, which itself is mounted to at least the base of the lamp envelope. (See, for example, the above-cited '915 patent).

So-called unprotected lamps, that is, lamps without a shroud for operation in an enclosed fixture, occasionally employ supports that do function as a part of the electrical circuitry of the lamp. It is with a starting aid for the latter form of lamp that this application is primarily directed.

DISCLOSURE OF INVENTION

It is, therefore, an object of the invention to obviate the disadvantages of the prior art.

It is another object of the invention to enhance arc discharge lamp operation.

These objects are accomplished, in one aspect of the invention, by an arc discharge lamp, having an arc tube assembly with a light transmissive arc tube containing an arc generating and sustaining medium, the arc tube including at least one press seal; means for coupling electrical energy to the interior of the arc tube including an electrical current-carrying frame member; a starting source comprising a sealed cavity in the press seal; a second fill material in the sealed cavity, the starting source emitting ultraviolet radiation which assists in initiation of an arc discharge within the interior of the arc tube; and an electrical energy coupler for coupling electrical energy to the sealed cavity. The electrical energy coupler comprises an electrically conducting element having a proximal end affixed to the electrical current-carrying flame and a distal end overlying the starting source.

This construction provides a simple and economical solution to starting aids for non-shrouded lamps.

BRIEF DESCRIPTION OF THE DRAWINGS

FIG. 2 is a diagrammatic elevational view of a prior art arc tube with a starting source in the press seal;

FIG. 3 is an elevational view of an embodiment of the invention; and

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
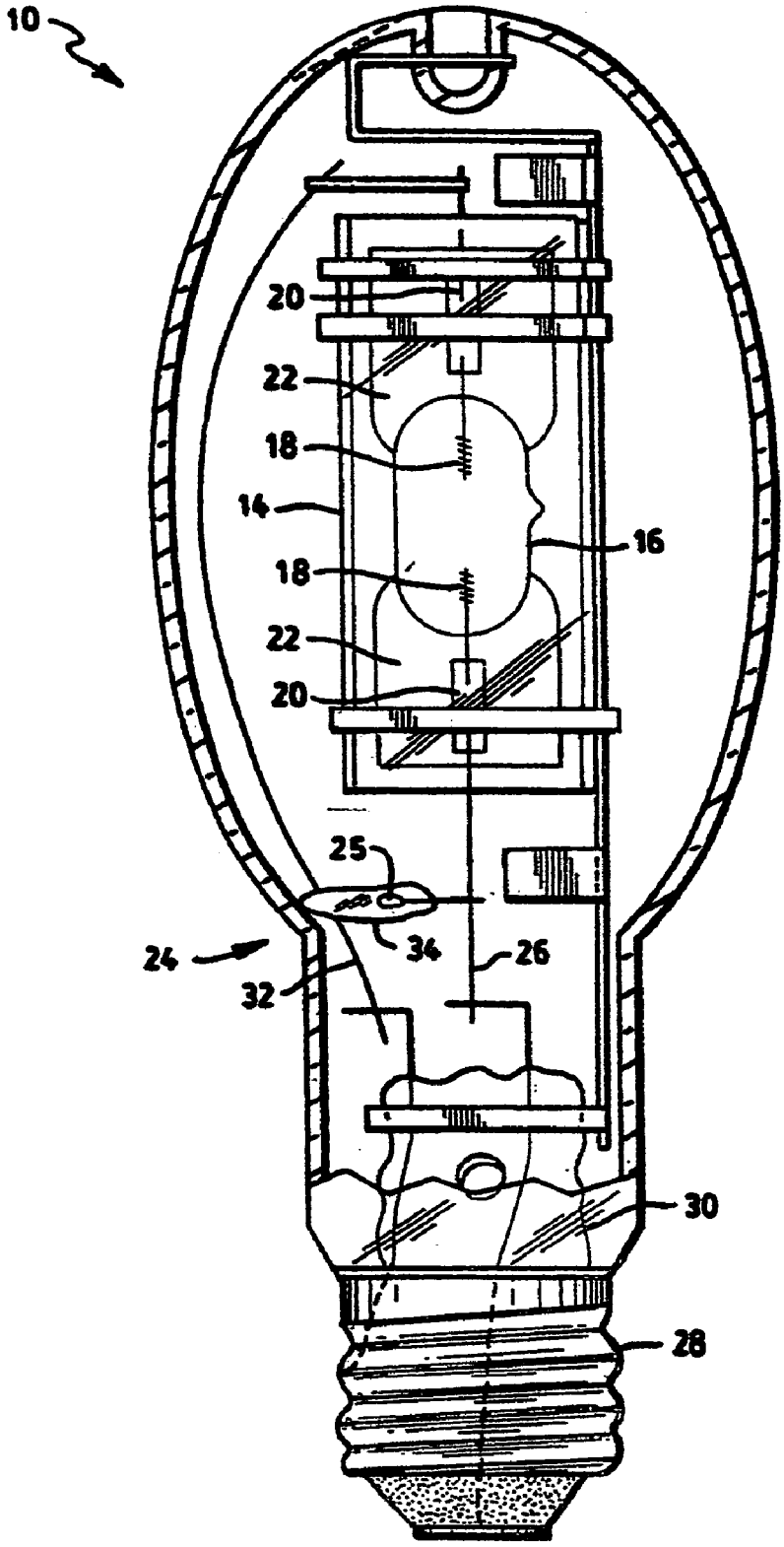
FIG. 1 PRIOR ART
FIG. 1 is an elevational view of a prior art lamp.

Referring now to the drawings with greater particularity, there is shown in FIG. 1 a prior art metal halide arc discharge lamp 10. A sealed envelope 12 encloses a cylindrical quartz sleeve or shroud 14. The sleeve 14 surrounds an arc tube 16 which encloses two electrodes 18 located at opposite ends of the arc tube and a fill material for generating and sustaining an arc discharge, e.g., a combination of mercury, metal halides, and argon. Each electrode is coupled to a molybdenum ribbon 20, which is enclosed within a press seal 22 that hermetically seals the arc tube. Electrical energy is coupled from a lamp base 28 through a lamp stem 30 and leads 32 and 26 to the electrodes 18 in the arc tube 16.

A UV enhancer 24 has a sealed envelope 34 that encloses an electrode 25. The electrode 25 is coupled to the lead 26, and is capacitively coupled to the lead 32, which may include a conductor that is helically wrapped around the envelope 34. A typical UV enhancer of this type is about 4.0 mm in diameter and 15.0 to 20.0 mm in overall length. Other details relating to the prior art UV enhancer 24 are disclosed in the '915 patent identified above. In this type of lamp 10, a floating frame 37 that is electrically isolated from the arc tube supports the arc tube-shroud assembly. The frame 37 comprises an elongated rod 37*a* that is supported at the lamp stem 30 and at the top of the envelope 12.

FIG. 2 illustrates a prior art technique such as that shown in the above-mentioned Morris patent, wherein the starting source was included in the press seal. As shown therein, a quartz arc tube 40 is sealed by two press seals 42 at opposite ends of the tube. Within each press seal is a molybdenum foil 44. Electrodes 46 located within the arc tube 40 and external leads 48 are connected to the molybdenum foils 44. A cavity 50 is formed in the press seal 42 so that it encloses a portion 51 of the foil 44. The foil 44 has at least one very sharp edge to provide high electric field concentration and to allow breakdown at lower voltages and higher pressures. The cavity 50 also encloses flush gases, such as nitrogen and argon, which are used in the press sealing process, a technique well known in the art. When the cavity 50 is formed, the flush gases are at a temperature near the melting point of the quartz arc tube 40. When these gases cool, the pressure within cavity 50 decreases to about one third to one-quarter atmosphere. An external ground plane 54 is attached to existing grounded frame parts allowing capacitive coupling between the foil 44 and the ground plane 54.

Referring now to FIG. 3, there is shown an embodiment of the present invention. Therein, arc discharge lamp 60 has an envelope 60*a*. An arc tube 62 is positioned within the envelope 60*a* and contains an arc generating and sustaining medium. The arc tube 62 includes at least one press seal 64. Means 66 for coupling electrical energy to the interior of the arc tube includes an electrical current-carrying flame member 68 and in-leads 68*a* and 68*b* sealed into the lamp stem 90 and connected to a base (not shown). A starting source 70 comprises a sealed cavity 72 formed in the press seal 64 and the cavity contains a second fill material and, as is known, can also contain a getter. The starting source 70 emits ultraviolet radiation when the lamp 60 is energized, which assists in initiation of the arc discharge within the interior of the arc tube 62. An electrical energy coupler 74 is provided for coupling electrical energy to the sealed cavity 72.

Figure 4:
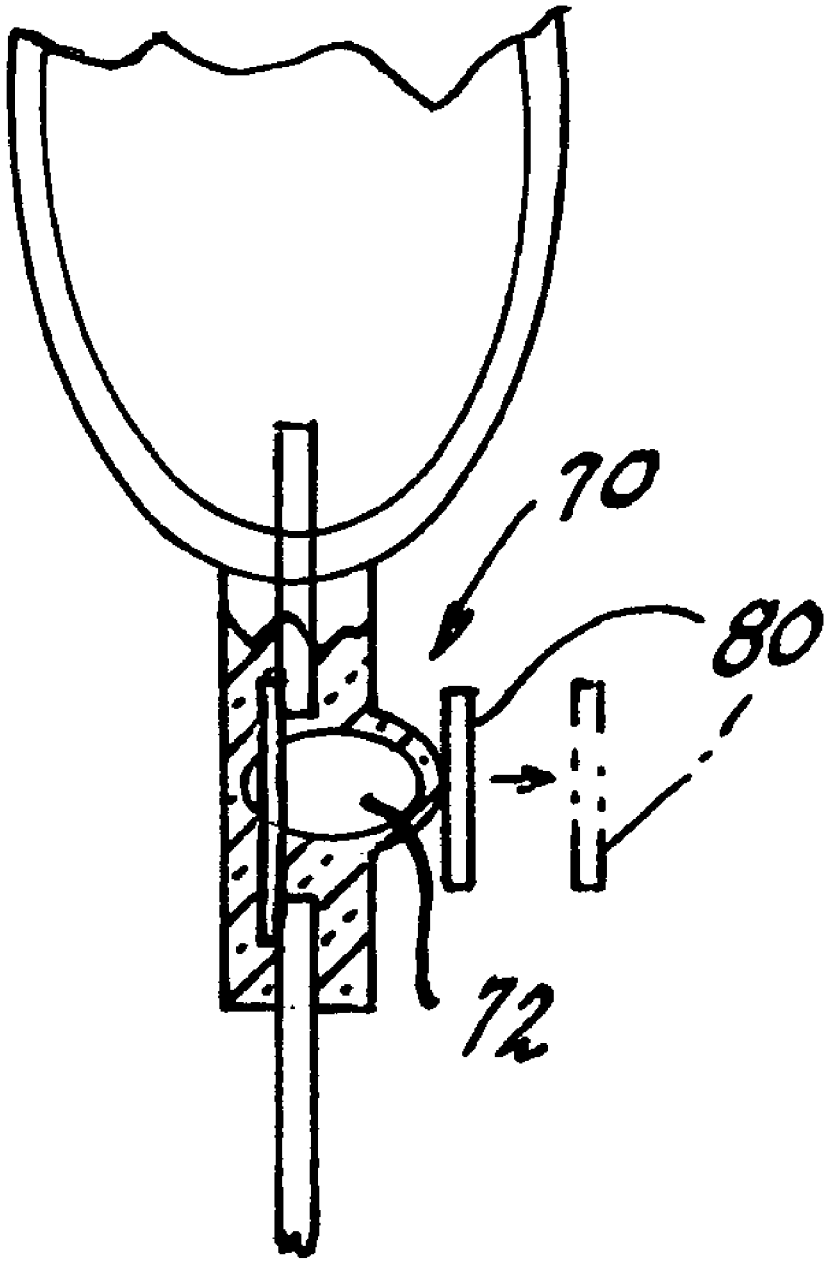
FIG. 4 is a partial view of an alternate embodiment of the invention.

The electrical energy coupler 74 comprises an electrically conducting element 76 having a proximal end 78 affixed to the electrical current-carrying flame 68 and a distal end 80 overlying the starting source 70, which includes a moly foil extension 70*a*, thus providing a capacitve coupling. While the electrically conducting element 76 can be nickel or other suitable material, in a preferred embodiment of the invention, shown in FIG. 4, the electrically conducting element 76 is a bimetal that will quickly move away from the cavity 72 as the lamp 60 heats up upon energization, thus minimizing the migration of sodium from the arc tube fill.

To further minimize sodium migration, that portion of the frame 68 that extends along the arc tube 62 is provided with an insulating sleeve 92, for example, of glass or ceramic material.

This invention thus provides a simple and expedient starting aid for non-e probe starting, closed fixture lamps. It is inexpensive and greatly reduces the number of parts required.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. In an arc discharge lamp, an arc tube having: a light transmissive arc tube containing an arc generating and sustaining medium, said arc tube including at least one press seal; means for coupling electrical energy to an interior of said arc tube including an electrical current-carrying flame member; a starting source comprising a sealed cavity in said press seal; a second fill material in said sealed cavity, said starting source emitting ultraviolet radiation which assists in initiation of an arc discharge within the interior of said arc tube; and an electrical energy coupler for coupling electrical energy to said sealed cavity, the improvement comprising:

said electrical energy coupler comprising an electrically conducting element having a proximal end affixed to said electrical current-carrying frame and a distal end overlying said starting source.

2. The arc discharge lamp of claim 1 wherein said electrically conducting element comprises a bimetallic ribbon.

3. The arc discharge lamp of claim 1 wherein said electrically conducting element is a nickel ribbon.

* * * * *

UNITED STATES PATENT AND TRADEMARK OFFICE

CERTIFICATE OF CORRECTION

PATENT NO. : 7,301,283 B1
APPLICATION NO. : 11/716337
DATED : November 27, 2007
INVENTOR(S) : Susan L. Callahan and David M. Hrubowchak It is certified that error appears in the above-identified patent and that said Letters Patent is hereby corrected as shown below:

Col. 3, line 18, "flame" should be --frame--
Col. 4, line 6, "non-e probe" should be --non-probe--

Signed and Sealed this

Eighth Day of April, 2008

JON W. DUDAS
*Director of the United States Patent and Trademark Office*